United States Patent [19]

Koch

[11] 3,992,991

[45] Nov. 23, 1976

[54] NON-ROTATING HANDWHEEL

[75] Inventor: Robert M. Koch, Wheaton, Ill.

[73] Assignee: Addressograph Multigraph Corporation, Cleveland, Ohio

[22] Filed: June 19, 1975

[21] Appl. No.: 588,303

[52] U.S. Cl. ..... 101/132; 74/625; 101/212; 192/95; 192/144

[51] Int. Cl.[2] ..... B41L 17/22

[58] Field of Search ..... 101/132, 132.5, 141, 101/142, 148, 212, 216; 74/625, 548; 192/95, 144

[56] References Cited

UNITED STATES PATENTS

| | | | |
|---|---|---|---|
| 2,900,842 | 8/1959 | Simpson | 74/625 |
| 3,150,750 | 9/1964 | Georges | 192/95 X |
| 3,190,416 | 6/1965 | Harter | 192/95 X |
| 3,292,453 | 12/1966 | Recknagel | 101/132 X |
| 3,372,607 | 3/1968 | Lathrop et al. | 74/625 |

*Primary Examiner*—Edgar S. Burr
*Assistant Examiner*—R. E. Suter

[57] ABSTRACT

A rotary duplicator includes a handwheel for manually moving the cylinders to insert and remove masters, to make adjustments, etc. To minimize risk to the operator when the machine is running, there is provided a means for disconnecting the handwheel automatically and holding it stationary whenever the machine is turned on.

2 Claims, 2 Drawing Figures

NON-ROTATING HANDWHEEL

BACKGROUND OF THE INVENTION

Rotary duplicators, such as the MULTILITH lithographic duplicator, manufactured by Addressograph-Multigraph Corporation, are normally provided with exposed handwheels which are used by the operator for various purposes. When the machine is turned off it is frequently desirable to rotate the cylinder slowly for various purposes such as to insert or remove masters, to clean the blanket between runs, to inspect the full surface of a master or of a blanket image, to remove infrequent paper jams, and the like.

Such handwheels are smoothly contoured so as to provide no openings or projections which would endanger the operator by catching his hands or clothing when the machine is operating. There is, however, in spite of the contouring of the wheel, a small residuum of exposure by reason of the fact that the handwheel is rotating rather rapidly when the machine is running.

SUMMARY OF THE INVENTION

To obviate even this small risk, it is desirable to avoid having the handwheel in motion during normal machine operation, and the present invention accomplishes this by providing a disconnecting means for the handwheel, which means comes into play automatically whenever the machine is turned on.

The disconnecting action is automatically terminated whenever the machine is turned off.

In addition, there is provided a resistance device or brake for preventing any idle rotation of the handwheel due to friction while the machine is running.

The arrangement is so designed that the handwheel itself is independent of the disconnecting controls and therefore it is not within the power of the operator to inadvertently override the disconnection and accidentally reconnect the handwheel while the machine is running.

DESCRIPTION OF THE PREFERRED EMBODIMENT

Figure 1:
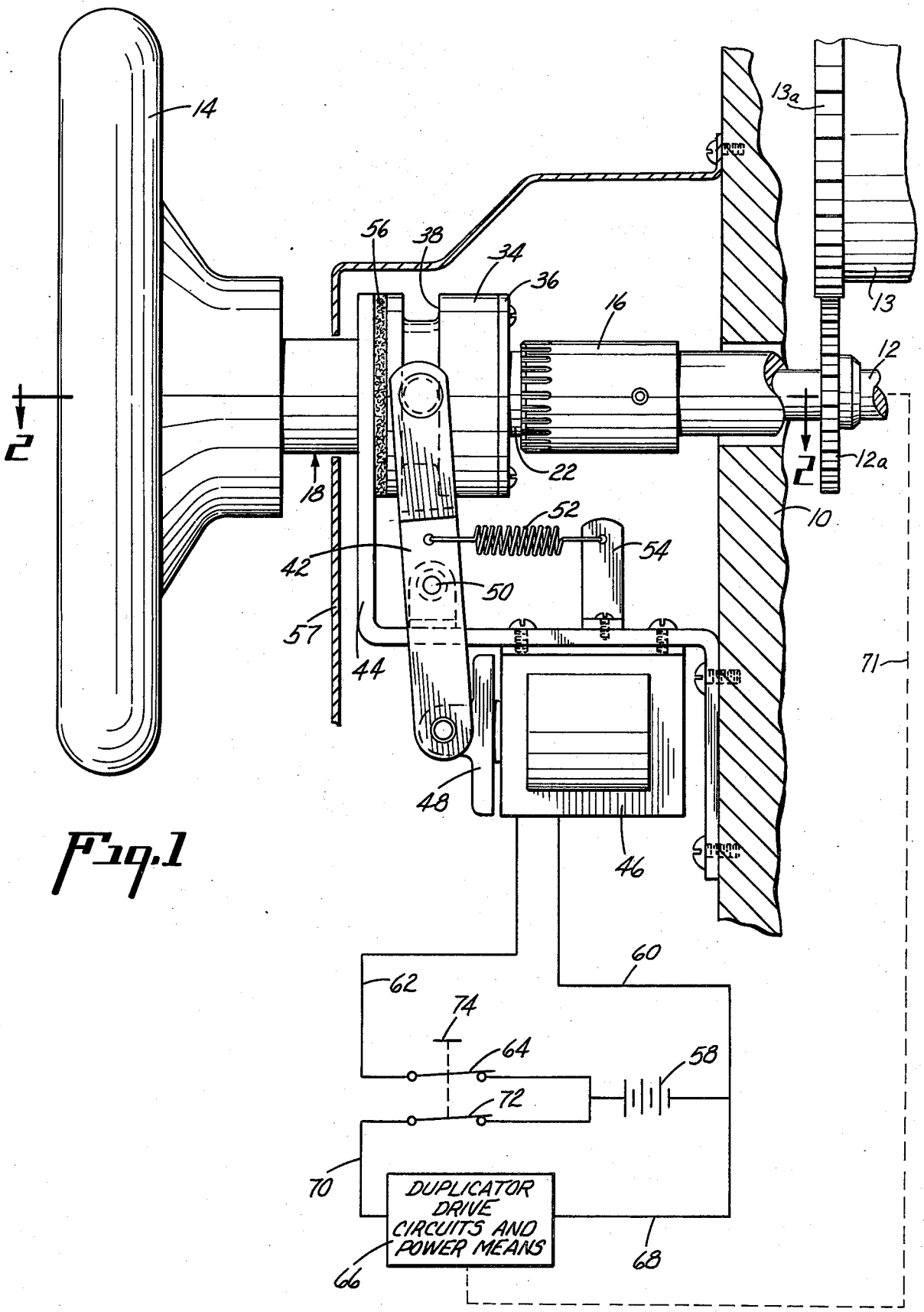
FIG. 1 is an elevation, partially in section, showing the portion of a duplicating machine which includes the handwheel and the disconnecting means of the present invention, as well as certain electrical connections schematically indicated, the parts being shown in disconnecting condition.

Referring to FIG. 1, numeral 10 indicates a portion of a frame of a rotary duplicating machine which has the customary printing cylinder or cylinders (not shown) mounted for rotation thereon.

Rotatable at all times with said cylinders, either by direct connection thereto or through a suitable geared connection is a shaft 12 which projects through one side of the frame 10 and normally carries a handwheel rigidly secured thereto. In FIG. 1 a printing cylinder 13 is shown which takes its drive from the shaft 12 via gears 12*a* and 13*a*.

In the device of the present invention, the shaft 12 carries a handwheel 14 in a manner that provides for relative rotation, and means is provided for drivingly connecting the handwheel to the shaft and disconnecting it therefrom.

In particular the shaft carries a first toothed clutch member 16 which is pinned to the shaft. The handwheel assembly, in this case, consists of the handwheel 14 itself and an axially extending sleeve 18 which is arranged for integral connection with the handwheel in a manner to be later explained in detail.

The sleeve, in a manner to be presently explained, is trapped on the end of the shaft 12 between the first clutch member 16 and a retaining washer 20, so that it is free to rotate thereon, but has only enough axial freedom to permit free rotation.

In the specific arrangement shown the sleeve 18 is made up of a sleeve body 18*a* to which is attached, with a tight press fit a metallic bushing 18*b*, preferably impregnated with lubricant. It is actually this bushing which, as a part of the sleeve 18, is trapped between the first clutch member 16 and the retaining washer 20.

It will be seen that the retaining washer 20 must first be placed within the sleeve body 18*a*, after which the bushing 18*b* is forced into place. When the assembled sleeve has been slipped over shaft 12, a screw 24 is used to attach the retaining washer 20 to the end face of the shaft 12, thereby mounting the sleeve 18 on the shaft 12 in a manner to provide free rotation while retaining the same firmly in place. Access for tightening or loosening the screw 24 is by way of the opening 26 in the end of the sleeve 18.

The handwheel 14 is finally firmly attached to the sleeve 18 by a transaxial screw 28.

As thus far described, the handwheel 14 and its sleeve 18 are rotatable on shaft 12 without any driving connection therebetween. However, the sleeve 18 also carries a projecting key 30 which rides in a keyway 32 formed on the interior of a second clutch member 34, slidable axially on the exterior of the sleeve.

Figure 2:
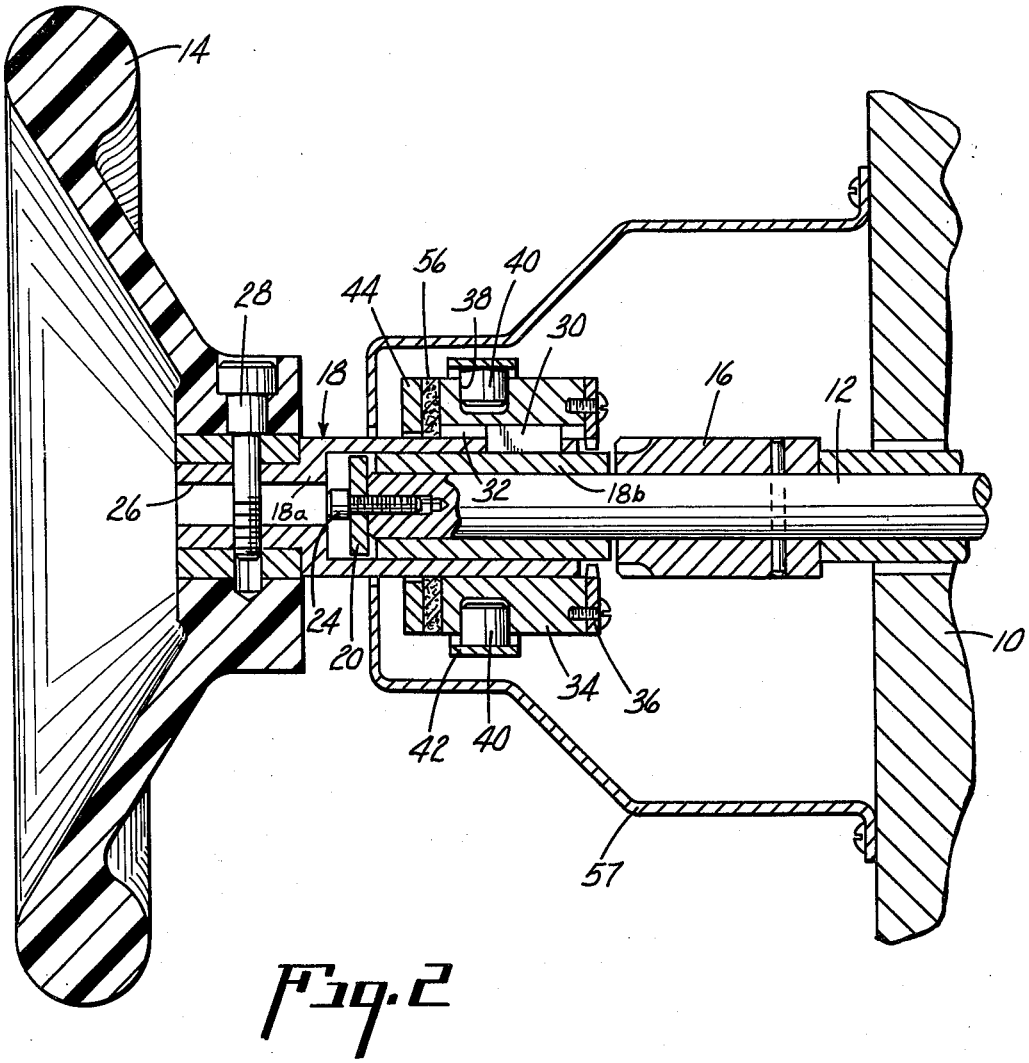
FIG. 2 is a section on line 2—2 of FIG. 1.

The clutch member 34 is thus arranged for rotary driving connection with sleeve 18 and the handwheel, while at the same time being free to slide on the exterior of the sleeve 18 within certain limits. At its right-hand end, as seen in FIGS. 1 and 2, the second clutch member carries an internally toothed ring 36 designed to mesh with the teeth of the first clutch member 16, and when the second clutch member is shifted to the right, it will engage the first clutch member to establish a driving connection between the shaft 12 on one hand, and the handwheel 14 and its sleeve 18 on the other.

The exterior of the second clutch member 34 is formed with an annular groove 38 which receives bosses 40 on the forked end of an operating lever 42.

As shown in the drawing, a bracket 44 is mounted on the frame 10 at one end and has its opposite end projecting to a position such that it embraces the shaft 12 between the handwheel 14 and the exterior face of the clutch member 34. Intermediate the ends of the bracket is mounted a solenoid 46 whose armature 48 is connected with one end of the operating lever 42, the latter being pivotally mounted on the bracket 44 as indicated at 50.

A tension spring 52 acts between the lever 42 and a spring perch 54 mounted on the bracket 44, and urges the clutch member 34 towards engagement with the clutch member 16.

Energization of the solenoid 46 causes the operating lever 42 to shift the clutch member 34 to the left, thereby disengaging it from the clutch member 16. In addition there is provided on the inner face of the bracket a brake shoe 56 against which the clutch member 34 is forced by the operating lever when the solenoid 46 is energized. This acts to immobilize the handwheel and prevent any rotation that might be imparted to it by frictional contact with the rotating shaft 12 while the machine is running.

Preferably a cover member 57 is mounted on the frame 10 in such manner as to house the foregoing components, other than the handwheel 14, and avoid any possibility of contact with the rotating shaft 12 when the machine is running.

As indicated diagrammatically in FIG. 1, the solenoid is supplied with power from a source 58 by conductors 60 and 62, the latter being interrupted by contacts 64. The duplicator drive circuits and power means 66 are similarly powered from the source 58 by conductors 68 and 70 the latter being interrupted by contacts 72, and the power means is connected to the shaft 12 by any suitable mechanical train as indicated diagrammatically at 71. As shown in the drawing, both contacts 64 and 72 are operated by a push button so that whenever the latter is operated to start the duplicator via contacts 72, contacts 64 will also close to energize the solenoid 46. It will be understood that means such as a relay or any other interconnecting arrangement may be provided to secure conjoint operation such that the act of turning on the duplicator will simultaneously bring about energization of solenoid 46.

OPERATION

In the drawing the parts are shown in the positions they would occupy with the machine running; i.e., contacts 64 and 72 are closed, solenoid 46 is energized and has pulled the lower end of lever 42 to the right, thereby acting to disengage the clutch members 34 and 16 against the force of spring 52. The shaft 12 is rotating, and the handwheel 14 is stationary since the second clutch member is held against the brake shoe 56 by the action of the solenoid.

When the operator desires to stop the machine to perform some adjustment or at the end of a run, he does so by operating the button 74 to open switches 64 and 72. This deenergizes the solenoid 46 and allows the spring 52 to become the major force on lever 42, whereby the clutch member 34 is shifted into engagement with clutch member 16.

Normally the clutch members will engage, but in case they should not do so, a small amount of movement of the handwheel by the operator in either direction will allow engagement.

The operator then can turn the shaft 12 by means of the handwheel 14 to effect whatever adjustment or resupply is needed to ready the machine for further operation. When this is complete, the push button 74 is actuated by the operator to close contacts 64 and 72, thereby starting the machine and restoring the parts to the position in FIG. 1 with the handwheel stationary.

While the normal starting and stopping characteristics of commercial duplicators are such that the equipment will operate properly as shown, it will be understood that if there should be any significant delay in bringing the shaft 12 to rest after actuating the button 74 to stop the machine, various arrangements such as a time delay or a motion sensing switch in the solenoid circuit, or shock absorbing elements in mechanical series with the clutch 16, 34 can readily be used to accommodate this situation.

As an additional safeguard, it is possible to include a sensing switch which will close only when the clutch member 34 moves to the left. By placing contacts controlled by this switch in series with the switch 72, operation of the machine can be prevented until it is certain that the declutching action has taken place. Normally, however, the reliability factors are such that this safeguard would be redundant.

What is claimed is:

1. A rotary duplicator comprising:

a rotary printing cylinder;

power means including a rotary shaft for driving the cylinder;

a handwheel rotatably mounted adjacent said shaft;

clutch means continuously drivingly connected to said handwheel and shiftable into and out of driving engagement with said shaft;

control means for starting and stopping the power means;

spring means urging said clutch means towards driving engagement with the shaft;

electromagnetic means for moving said clutch means to a position out of driving engagement with the shaft and holding the same in such position in opposition to said spring means; and means responsive to activation of said control means to starting condition for energizing said electromagnetic means, and responsive to activation of said control means to stopping condition for deenergizing said electromagnetic means.

2. A rotary duplicator as set forth in claim 1 which includes brake means positioned to coact with the clutch means when the latter is held out of engagement with said shaft by said electromagnetic means.

* * * * *